US005799816A

United States Patent [19]

Schubert

[11] Patent Number: 5,799,816

[45] Date of Patent: Sep. 1, 1998

[54] TABS FOR EASY-OPEN CAN END

[75] Inventor: James R. Schubert, Dayton, Ohio

[73] Assignee: Dayton Systems Group, Inc., Dayton, Ohio

[21] Appl. No.: 792,898

[22] Filed: Jan. 31, 1997

[51] Int. Cl.[6] ..... B65D 17/34

[52] U.S. Cl. ..... 220/269; 220/906

[58] Field of Search ..... 220/269, 270, 220/271, 272, 273, 906

[56] References Cited

U.S. PATENT DOCUMENTS

| | | | |
|---|---|---|---|
| 4,015,744 | 4/1977 | Brown | 220/269 |
| 4,130,074 | 12/1978 | Cudzik | 220/269 X |
| 4,148,410 | 4/1979 | Brown | 220/269 |
| 4,465,204 | 8/1984 | Kaminski et al. | 220/269 |
| 4,930,658 | 6/1990 | McEldowney | 220/269 |
| 5,385,254 | 1/1995 | Hannon | 220/269 |

*Primary Examiner*—Stephen Cronin

*Attorney, Agent, or Firm*—Joseph G. Nauman

[57] ABSTRACT

A tab for use with an easy-open can end, which is made free from any protrusion with a cut edge thereon that would otherwise contact a finger or a lip of the user without a increasing the number of manufacturing steps to complete the tab. A tab having a body, a nose end with a tip, an opposite grip end, and an island formed within the tab body and attached to the nose end along a hinge, the island including a rivet hole for receiving a rivet on a can end panel to attach the tab to the end panel. The tab body is joined to a carrier strip, from which the tabs are made, by a joint formed in a tab making process. In a tab severing process, the joint is cut off to sever the tab from the strip, leaving a protrusion on the tab with a cut edge. The tip of the nose has a gap into which the protrusion can be bent or curled, to guard the cut edge, as the tab is moved to attach the island to the end panel with a rivet. When the tab is lowered in the downward passage, the swing arm moves to cause the curling surface to press the tab and curl the protrusion onto the tab.

4 Claims, 3 Drawing Sheets

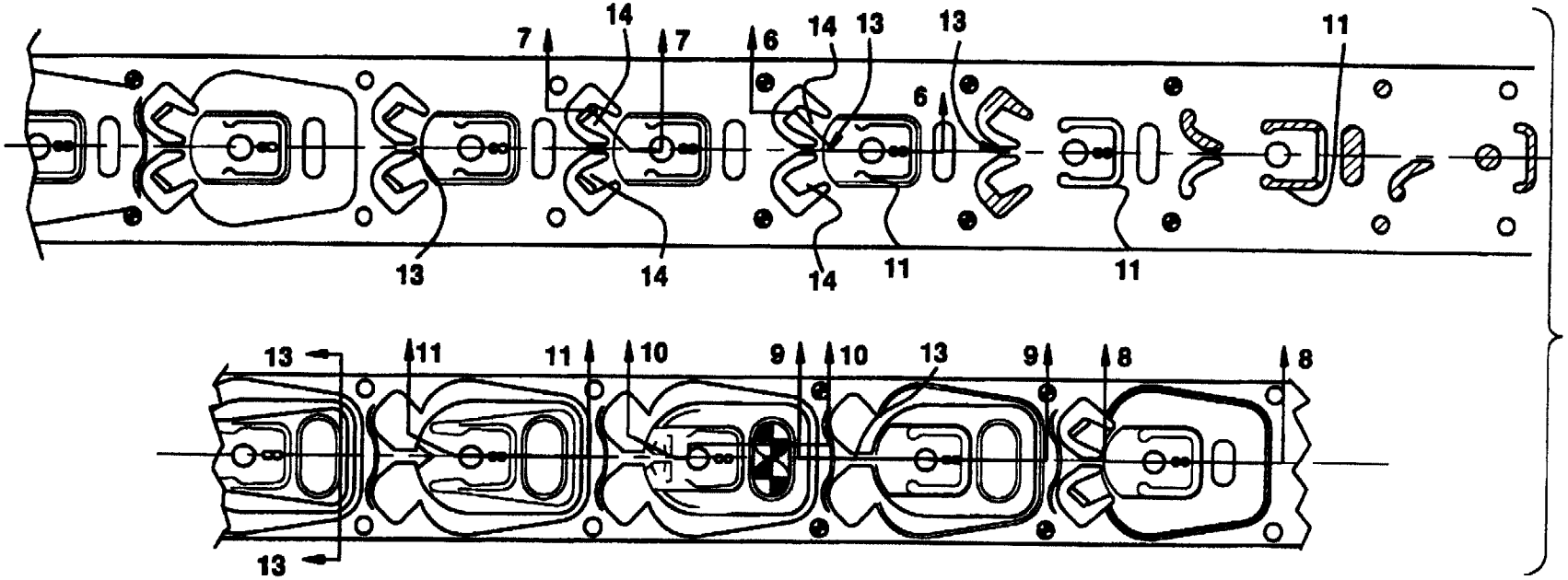
FIG.5
FIG. 6
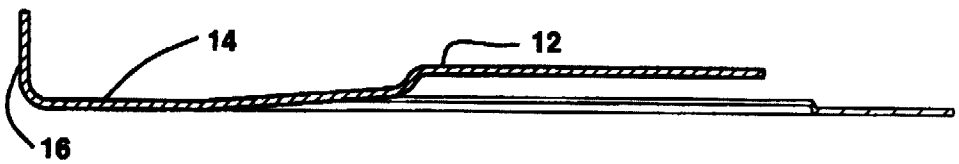
FIG. 7
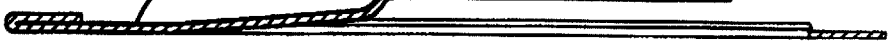

TABS FOR EASY-OPEN CAN END

CROSS REFERENCE TO RELATED APPLICATION

This application is related to U.S. patent application Ser. No. 08/792895 filed Jan. 31, 1997, now U.S. Pat. No. 5,741,105 entitled METHOD OF AND APPARATUS FOR MANUFACTURING TABS FOR EASY-OPEN CAN END.

FIELD OF THE INVENTION

The present invention relates to a tab secured to an upper surface of an easy-open can end for opening a tear panel in the can end when the tab is lifted.

BACKGROUND OF THE INVENTION

Easy-open can ends, which can be opened by lifting and pulling tabs mounted thereon, used on cans for containing beverages, etc., are well known in the art. In recent years, retained tab easy-open can ends which keep the tab attached to the end panel after they are opened, have been the predominant type. Specifically, the retained tab easy-open can end has an integral rivet projecting upwardly from the end panel, an openable area or tear panel surrounded by a score line which is of a partly discontinuous annular shape, and an operating tab fixed to the end panel by a tongue which has a rivet hole that receives the rivet. The tab includes a tip end positioned over a part of the tear panel, and a grip ring disposed on its rear end remote from the tip end. When the grip ring of the tab is lifted off the end panel, the tip end of the tab presses a region of the openable area, transferring an upward force to the front edge of the rivet, and causing the initial breaking or "pop" of the score. Continued lifting of the tab then causes the tab to pivot at the rivet island hinge applying continued force on the nose to complete the tear panel opening.

A tab for use on such a retained tab easy-open can end is typically manufactured as follows. First, a tab blank, which is larger than an actual finished tab, is blanked out of a strip of metal that is unreeled from a metal strip coil. It should be noted the completed tab is not totally detached from, but remains partly joined to, the strip by a joint or "carry strip" until such time as the tab is attached (staked) to an end panel. Next, the tab blank is punched with grip holes for incremental feeding of the strip and attached tabs, and with holes which are used in forming a tongue, a rivet hole, and a grip. Thereafter, the tab blank is formed with a predetermined pattern of convex and concave shapes, and curled (for improved rigidity) along its peripheral edge into a final tab profile. The joint is then severed to separate the tab from the strip, while the tab is fixed to a rivet on a can end through the rivet hole in the tongue.

When the tab is severed from the strip, a protrusion is left at a cut edge of the severed joint projecting from an outer edge of the tab. In beverage can end tabs the joint is often positioned on the grip end of the tab, and thus a protrusion is formed on the grip end when the joint is severed. When the grip end of the tab is lifted by a finger, a sharp cut edge of such protrusion tends to contact the finger, making the user feel uncomfortable. If, on the other hand, the joint is positioned on the nose end of the tab (as more often used on tabs for full panel ends on food cans), then the protrusion is formed on the tip end of the tab nose when the joint is severed. Heretofore, when this type of "nose carrier" tab is used on beverage cans, when can end is opened the pouring aperture may contact a lip of the user, and the sharp cut edge of the protrusion is liable to come into contact with the lip, also making the user feel uncomfortable, perhaps catching on facial hair or scratching the user. There are, however, some advantages to using a nose carrier attachment between the tabs and the metal carrier strip from which the tabs are formed.

Consequently, it has been proposed to manufacture a tab according to such proposed method but such proposal requires a stage for forming a special joint in addition to a stage for cutting off the joint at the end close to the strip. If one considers the scoring of the carry strip an additional station (usually in the die bridge) is needed. In general, it is quite difficult, if not impossible, to get a punch and opposing die close to the edge of the tab. Thus, current pinch score techniques have been tried, followed by breaking the tab out of the skeleton over cut off knives, but this approach encounters problems of controlling score depth. If a score is too deep, this can tear up thin tabs or cause premature break outs or defects of metal properties on specifications. All these can lead to difficulties in running of can end conversion equipment in which the tab forming and attaching (staking) features are incorporated. Further, an unsupported rivet island requires less forming stations but has disadvantages of producing higher opening (pop) forces, less tab bends (the number of successive bends at the tab/island connection before the tab breaks off), and requiring heavier gage material for the same tab strength, as compared to a tab with a structure having a rivet island support.

Other problems of attaching the tab in one continuous staking motion create critical timing of tab attaching and rivet head formation, which require in some applications a pre-stake operation and then final clinch. Thus, for practical reasons the current tab types avoid having a nose carrier.

Another factor to be considered is that in use operation forces on a tab of the retained (ecology) type during its opening or operating cycle can cause side loads on the tab nose that tend to turn the tab, reducing opening margin. Additionally, accidental turning of the tab prior to commencing the opening cycle can cause the end to fail to open.

SUMMARY OF THE INVENTION

It is an object of the present invention to provide a retained tab for an easy open can end, which tab when attached to and end panel, is free from any protrusion thereon that would otherwise contact a finger or a lip of the user. Such tab is uniquely adapted to the method and apparatus which is the subject of the related application.

To achieve the above object, there is provided in accordance with the present invention a tab for use with an easy-open can end, which tab is fixed to an end panel by an integral rivet and is capable of opening the can end by tearing an openable area (pour panel) surrounded by a score on the end panel when the tab is lifted. The tab has an island with a rivet hole which receives the rivet and also has a grip end, such as a grip ring, the tab being joined at its nose to a strip from which the tab is blanked. The joint is severed to free the tab from the strip. The severing operation comprises positioning a tab, still attached to the strip, in a tab severing position, cutting off the joint thereby to sever the tab from the strip, and lowering the released tab, which has formed with a protrusion at the tab nose having a cut edge where the joint has been severed.

In this operation, the tab is held against horizontal movement, and the protrusion on the tab nose is contacted by a curved curling surface on a free (distal) end of a swing arm, which arm has an anchored (proximal) end pivotally supported on a side of a downward passage in which the tab is lowered. The swing arm is moveable in the downward passage, and is normally urged to swing upwardly by a spring means. Swinging motion of the swing arm as the tab is lowered presses the curling surface against the protrusion to curl the protrusion on the tab back against the tab nose.

The tab is attached to the end panel by further lowering the tab following the tab severing step, and after the swing arm has moved past the pressing position, releasing the swing arm from abutment against the tab and allowing the arm to swing upwardly under the bias of the spring means. Then the rivet hole in the tab is placed over the rivet on an end panel supported in the position to which the tab is lowered, and the rivet is compressed (staked) thereby fixing the tab to the end panel.

According to the present invention, the joint between the strip and the tab can be cut off, close to the tab nose and the protrusion can be curled into a gap left in the tab tip, in a sequence of steps carried out by the tab severing apparatus as it lowers the tab from the tab severing position at which the tab is severed from the strip.

Specifically, in the tab severing apparatus, the tab lowering means is moved toward a tab on the strip which is positioned in the tab severing position. At the same time, the joint is cut close to the tab nose by the cutter of the severing means which moves toward the joint in synchronism with the tab lowering means. The tab is severed from the strip, and a cut edge of the joint remains as a protrusion on the tab nose. Since the protrusion with its sharp cut edge could make the user feel uncomfortable when contacting the edge with a finger or a lip, the protrusion is curled back onto the tab. As explained in the related application, following the above descent of the tab, the tab is further lowered by the tab lowering means until the protrusion is engaged by the curling surface of the swing arm which is positioned below the tab severing position.

The protrusion, and specifically its cut edge, is now curled back onto the tab preferably into the gap, and into a shape which will not contact a finger or a lip of the user. Since the protrusion is curled onto the tab immediately after the tab is severed from the strip, the tab can be manufactured without an increase in the number of manufacturing steps.

Thus, with design of tab provided by the invention, and particularly its tip or nose portion, the remaining protrusion at the tab nose can be curled onto the tab and the tab can be attached (riveted or staked) to the end panel all at one existing operating station. Stated another way, the nose strip severance, and curling of the remaining protuberance into a guarded location upon descent of the tab from the severing position, is achieved at the attaching and riveting station. Consequently, the tab can be manufactured efficiently by a simple apparatus arrangement without the need for additional working stations in the tab tooling.

The tongues, which form the nose of the tab and the nose tip cavity into which the protrusion can be moved, additionally have double folded ends which are located under the hinge connection of the island to the remainder of the tab so as to locate the axis of the tab tilting motion at a elevation with respect to the island and end panel, which enhances the continuous action of the tab nose to open the our panel, and this in turn reduces the force necessary for the tab to produce such necessary result.

Furthermore, the island of the tab is located securely against the end panel around the integral rivet when the rivet is staked, and the island is provided with an anti-rotation feature which maintains proper alignment of the tab and particularly its nose to minimize failed openings.

Other objects and advantages of the invention will be apparent from the following description, the accompanying drawings and the appended claims.

BRIEF DESCRIPTION OF THE DRAWINGS

FIG. 5 is a view of a carrier strip of metal showing the sequential forming of the tabs;

FIG. 6 is an enlarged cross-section view taken on line 6—6 in FIG. 5;

FIG. 7 is an enlarged cross-section view taken on line 7—7 in FIG. 5;

DESCRIPTION OF THE PREFERRED EMBODIMENT

Figure 1:
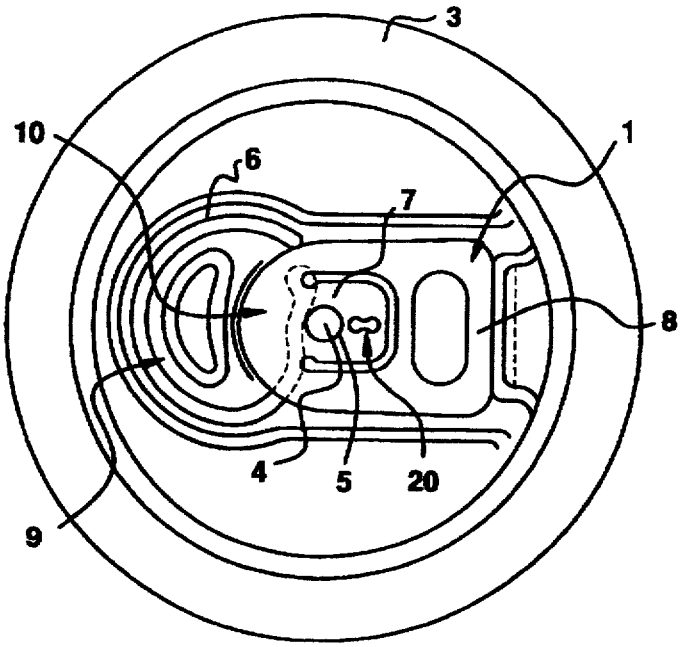
FIG. 1 is a top view of a typical easy-open can and end with the tab of the invention in place.
Figure 2:
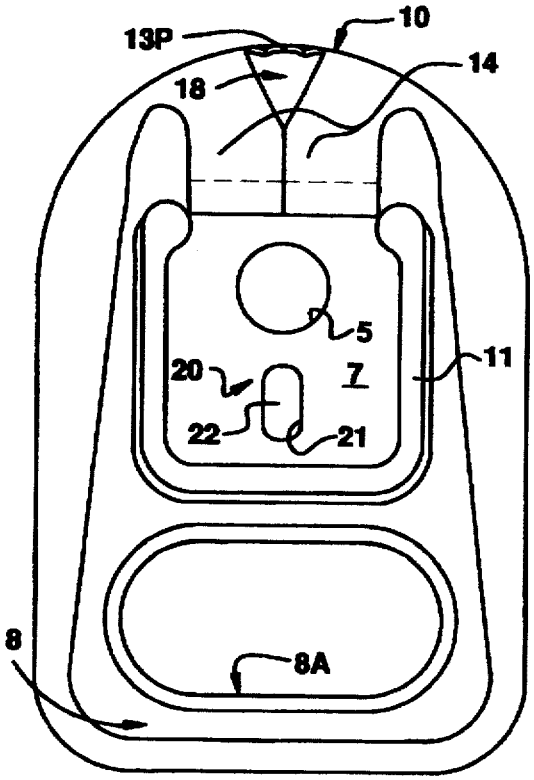
FIG. 2 is an enlarged partial cross-section taken through the anti-rotation feature in the rivet island in FIG. 1.
Figure 3:
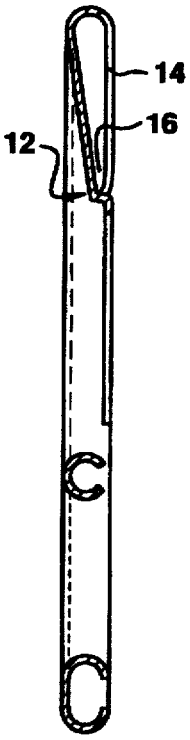
FIG. 3 is an enlarged bottom view of the tab itself.
Figure 4:
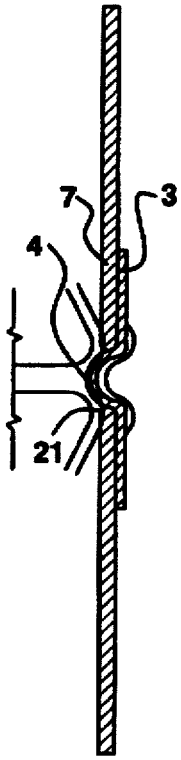
FIG. 4 is a cross-section view taken vertically through FIG. 3.
Figure 8:
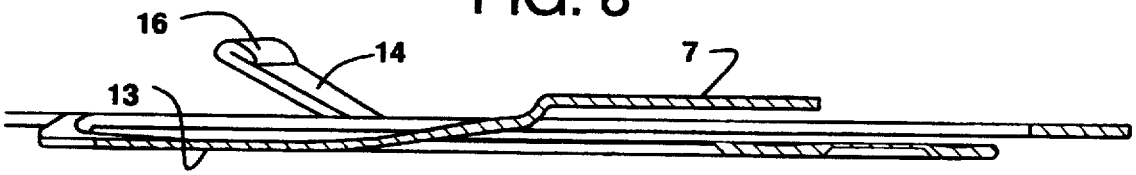
FIG. 8 is an enlarged cross-section view taken on line 8—8 in FIG. 5.
Figure 9:
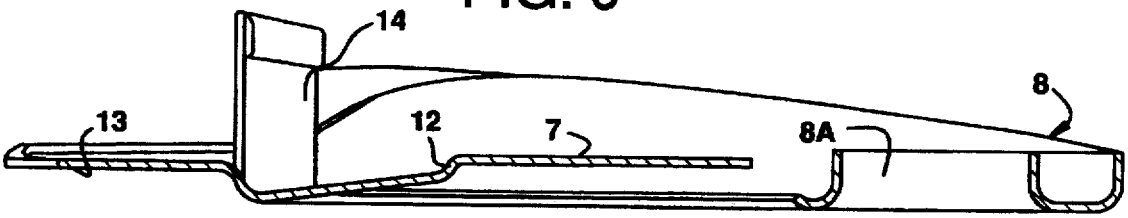
FIG. 9 is an enlarged cross-section view taken on line 9—9 in FIG. 5.
Figure 10:
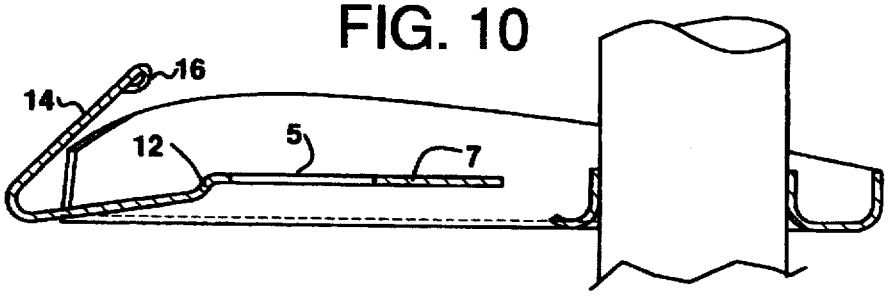
FIG. 10 is an enlarged cross-section view taken on line 10—10 in FIG. 5.
Figure 11:
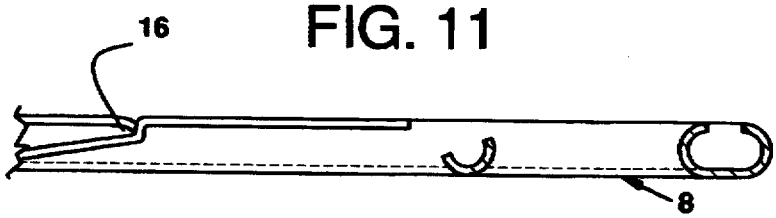
FIG. 11 is an enlarged cross-section view taken on line 11—11 in FIG. 5.
Figure 12:
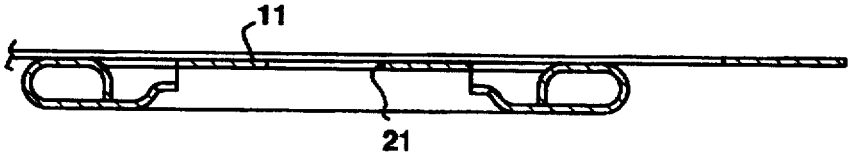
FIG. 12 is an enlarged cross-section view taken on line 12—12 in FIG. 5.
Figure 13:
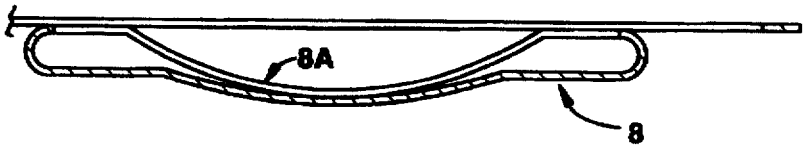
FIG. 13 is an enlarged cross-section view taken on line 13—13 in FIG. 5.

A tab 1 manufactured according to the embodiment of the present invention is suitable for use on a stay-on tab easy-open can end. As shown in FIG. 1, the completed can structure comprises a disk-shaped end panel 3 and the operating tab 1 mounted thereon, secured to a rim of can body 2. The end panel 3 has a rivet 4 by which the tab 1 is mounted on the end panel 3 and a score 6 which is of a partly discontinuous annular or loop shape and extends along and defines an openable area or pour panel 9 of the end panel 3. The tab 1 has an island or tongue 7 having a rivet hole 5 in which the rivet 4 is inserted. A grip 8 which may include a hole 8A located on a rear end of tab 1, and a tip end or nose 10 of the tab is positioned over pour panel 9 at a point where score line 6 is to be initially fractured.

When the grip end 8 is lifted off end panel 3, nose 10 presses the pour panel 9, separating it along score line 6. At the end of such lifting action, pour panel 9 is bent toward the product side of the can end 2 and inward thereof about a discontinuous or hinge region of the score 6, thereby to open a pouring aperture in the can end. Island 7 is separated from the rest of the tab, except for a hinge connection 12, by a U-shaped gap 11.

The sequence of manufacturing the tab 1 according to the embodiment of the present invention is illustrated in FIGS. 5–13. The tab as it is formed is shown inverted, e.g. the uppermost surfaces in section views FIGS. 6–13 are surfaces which ultimately face the outer or public surface of end panel 3. Details are disclosed in the aforementioned related application; the tab 1 is formed by a tab forming process which uses tab tooling punches and dies, not shown. As shown in FIG. 5, tabs 1 are formed from a strip of metal S unreeled from a metal strip coil, the tabs are joined to the carrier strip by joints 13. More specifically, in the tab forming process as shown by the progressively illustrated results of the tool and die actions on the strip, the island or tongue 7 is blanked out of the strip 12 and a rivet hole 5 is punched in the island, nose tongues 14 on opposite sides of a joint 13 and forming the tip or nose end 10 are blanked out of strip S, and a hole 15 may be formed in grip end 8. The tips 16 of tongues 14 are bent back upon the tongues (see FIGS. 5, 6 & 7). Then, as shown at the top left part of FIG. 5, the outline or perimeter of a tab blank which is larger than the ultimate resulting tab, is blanked out of the strip S.

Thereafter, as shown in FIGS. 5, 8, 9, 10 & 11, the nose tongues 14 are bent back over the nose and the peripheral edge of the tab blank is bent over into conformity with the shape of a tab 1. Now, the completed tab is formed, joined at its nose to the strip S by the joint 13.

The strip, with tabs attached, is carried to a staking/attaching station in the main tooling of the apparatus for fixing tabs 1 to end panels 3. Then, as shown in the related application, a tab 1 is cut off the strip 12 in a tab severing process comprising a succession of steps, namely cutting joint 13, curling a resulting protrusion 13P (formed on tab nose 10 between the folded over tongues 14 when joint 13 is severed) into the gap or space 18 between the tongues, and then placing the tab onto the rivet 4 on an end panel, with the rivet projecting through the rivet hole 5. Finally, the rivet is staked to attach the tab to the end panel.

The protrusion 13P is thus curled back into, and then guarded by, the nose of the tab, which is free from any protrusion that would otherwise contact a finger or a lip of the user.

The underside of island 7 is located on a plane with the underside of the tab (see FIGS. 2, 4, 10 & 12), so the island will fit firmly against the end panel 3 as rivet 4 is staked. The extended oval hole 21 of the anti-rotation formation 20 in island 7 will engage around an oval bead 22 in end panel 3, to resist any rotation of the tab once it is staked in place on the end panel. If desired, bead 22 can be formed in the end panel after staking of rivet 4.

Also, the folded under (double folded) tips 16 of tongues 14 form a raised fulcrum for the hinge connection 8, providing better leverage for tab nose 10 as it is pressed against score line 6 to achieve the initial break or "pop" of the score line.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A tab for attachment by a rivet to an easy-open can end panel and capable of opening the can end by tearing a pour panel defined by a score on the end panel when a grip portion of the tab is lifted, comprising an elongated tab body having a nose end with a tip and an opposite grip end, an island formed within said tab body and integrally attached to said nose end along a hinge connection, said island including a rivet hole for receiving a rivet on the end panel to attach the tab to the end panel with said tip overlying a portion of the pour panel at the score, said grip portion having a rolled end, one of said ends including a pair of tongues, said tongues being folded back against said one end, said folded back tongues defining a gap at said one end into which a protrusion from said one end, resulting from severing a connecting strip used to locate the tab, is rolled to place a cut edge of said protrusion in a guarded location in said gap.

2. A tab for attachment by a rivet to an easy-open can end panel and capable of opening the can end by tearing a pour panel defined by a score on the end panel when a grip portion of the tab is lifted to form a pour opening through the area of the can end covered by the pour panel, comprising an elongated tab body having a nose end with a tip and an opposite grip end, an island formed within said tab body and integrally attached to said nose end along a hinge connection, said island including a rivet hole for receiving a rivet on the end panel to attach the tab to the end panel with said tip overlying a portion of the pour panel at the score, said grip portion having a rolled end, folded wing portions extending along opposite sides of said tab from said rolled end past said island and said hinge connection to adjacent said nose portion, said nose portion including a pair of tongues having double folded ends and said tongues being folded back against said nose portion with said double folded ends located adjacent said hinge connection, said folded back tongues defining a gap at said tip into which a protrusion from said tip is rolled to place any cut edge of said protrusion in a guarded location in said gap.

3. A tab as defined in claim 2, further comprising said island having an aperture spaced from said rivet hole, said aperture being adapted to interact with a bead on the end panel to inhibit turning of said tab body around said rivet such as to move said tip away from the score.

4. A tab as defined in claim 3, further comprising said aperture having and elongated inner edge to interact with the sides of an elongated bead formed in the end panel.

* * * * *